US009603470B2

(12) United States Patent
Gao

(10) Patent No.: US 9,603,470 B2
(45) Date of Patent: Mar. 28, 2017

(54) APPARATUS FOR COMMUNICATION, EXPRESSION, DISPLAYING PICTURES AND GREETING

(71) Applicant: Lijun Gao, Toledo, OH (US)

(72) Inventor: Lijun Gao, Toledo, OH (US)

( * ) Notice: Subject to any disclaimer, the term of this patent is extended or adjusted under 35 U.S.C. 154(b) by 0 days.

(21) Appl. No.: 14/589,959

(22) Filed: Jan. 5, 2015

(65) Prior Publication Data

US 2016/0192791 A1 Jul. 7, 2016

(51) Int. Cl.
*A47G 1/06* (2006.01)
*A47G 1/14* (2006.01)

(52) U.S. Cl.
CPC ..... *A47G 1/0616* (2013.01); *A47G 1/14* (2013.01); *A47G 2001/0688* (2013.01)

(58) Field of Classification Search
CPC ..... A47G 1/06; A47G 2001/0677; A47G 2001/0694; A47G 2001/0688
See application file for complete search history.

(56) References Cited

U.S. PATENT DOCUMENTS 1,448,664 A * 3/1923 Hull ..... G09F 7/22 211/169
1,788,209 A * 1/1931 Sheehan ..... A47G 1/14 359/840
2,649,799 A * 8/1953 Spertus ..... A47G 1/06 248/472
3,681,867 A * 8/1972 Bilodeau ..... A47G 1/06 40/759
4,376,348 A * 3/1983 Ackeret ..... A47G 1/143 40/490
4,571,865 A * 2/1986 Ackeret ..... G09F 11/30 40/122
4,750,282 A * 6/1988 Zennedjian ..... A47G 1/06 40/611.11
4,763,428 A * 8/1988 Fischer ..... A47G 1/0655 40/606.09
6,460,280 B1 * 10/2002 Haines-Woon ..... A47G 1/06 40/768

(Continued)

*Primary Examiner* — Gary Hoge

(57) ABSTRACT

One embodiment of the current application is a device that can mount to a surface or stand on a table and interchangeably displays one or more sheets of materials. The device comprises a front panel and a back panel. One or more linear wave springs are installed between the two panels. Sheets of materials can be inserted in-between one of the two panels and the linear wave springs. The linear wave springs hold the sheets of materials onto the front panel and/or the back panel. The visual information on the sheets is displayed through one or more display windows on the panels.

Another embodiment of the current application is a device that displays a long sheet of material. There are images and/or messages of personal status, feeling, emotion, expression, or greeting on the long sheet of material. The long sheet of material passes over a supporting panel and is attached to two parallel rollers. The top and bottom portions of the supporting panel are curve shaped and flexible. The curved and flexible portion of the panel help keep the long sheet of material in tension. Three mesh well gears can rotate the rollers in synchronism. One of the three gears partially extrudes out of the device housing to be driven by human hands.

11 Claims, 13 Drawing Sheets

(56) References Cited

U.S. PATENT DOCUMENTS

| | | | | |
|---|---|---|---|---|
| 6,467,210 | B1 * | 10/2002 | Chang | A47G 1/06 40/732 |
| 7,430,824 | B1 * | 10/2008 | Ngan | G09F 3/20 40/600 |
| 2003/0079393 | A1 * | 5/2003 | Goodwin | A47G 1/0616 40/717 |
| 2013/0104433 | A1 * | 5/2013 | Justin, III | G03H 1/0005 40/714 |

* cited by examiner

APPARATUS FOR COMMUNICATION, EXPRESSION, DISPLAYING PICTURES AND GREETING

CROSS-REFERENCE TO RELATED APPLICATIONS

This application claims the benefit of provisional patent application Ser. No. 61/924,614, filed 2013 Jan. 7 by the present inventor.

FEDERALLY SPONSORED RESEARCH

Not Applicable

SEQUENCE LISTING OR PROGRAM

Not Applicable

BACKGROUND OF THE INVENTION

Field of Invention

The present application relates to signage and methods of using the signage, particularly using the signage to show and communicate personal feeling, emotion, and status. At least one embodiment also relates to picture frames; At least one embodiment also relates to greeting cards, more particularly to a greeting box that contains multiple greeting images and messages.

Prior Art

US 2013/0125432 A1 disclosed a flip style, status card collection, but it does not allow users to have their own printed status message or image to be displayed easily.

U.S. Pat. No. 7,146,758 B1 disclosed a personal office status sign with extra storage pockets to contain extra status cards. However, the display pocket can only contain one status card.

SUMMARY OF THE INVENTION

The current application is for expressing and conveying personal emotion, feeling, and status quickly, easily, and conveniently. At least one embodiment of the current application can also be used as a picture frame, and at least one embodiment of the current application can be used as a greeting box that contains multiple greeting images and/or messages.

It is a principal object to provide an apparatus and method by which a person can communicate his or her status, feelings, and emotions easily, effectively, and conveniently.

It is another object to provide a device to allow users to easily display their own printed or custom made image and/or messages.

It is another object to provide a device to be able to firmly hold different numbers of display sheets with various thicknesses in the same display housing.

It is another object to provide a picture frame that can change display pictures easily.

It is another object to provide a greeting device that can contain multiple images and messages. The device can serve as an alternative to greeting cards.

It is a further object is to provide a device that is economical in cost to manufacture.

Further objects of the application will appear as the description proceeds.

DRAWINGS—FIGURES

DETAILED DESCRIPTION

In the following description, it is to be understood that such terms as "top," "bottom," "front," "back," and the like, are words of convenience and are not to be construed as limiting terms.

Figure 1:
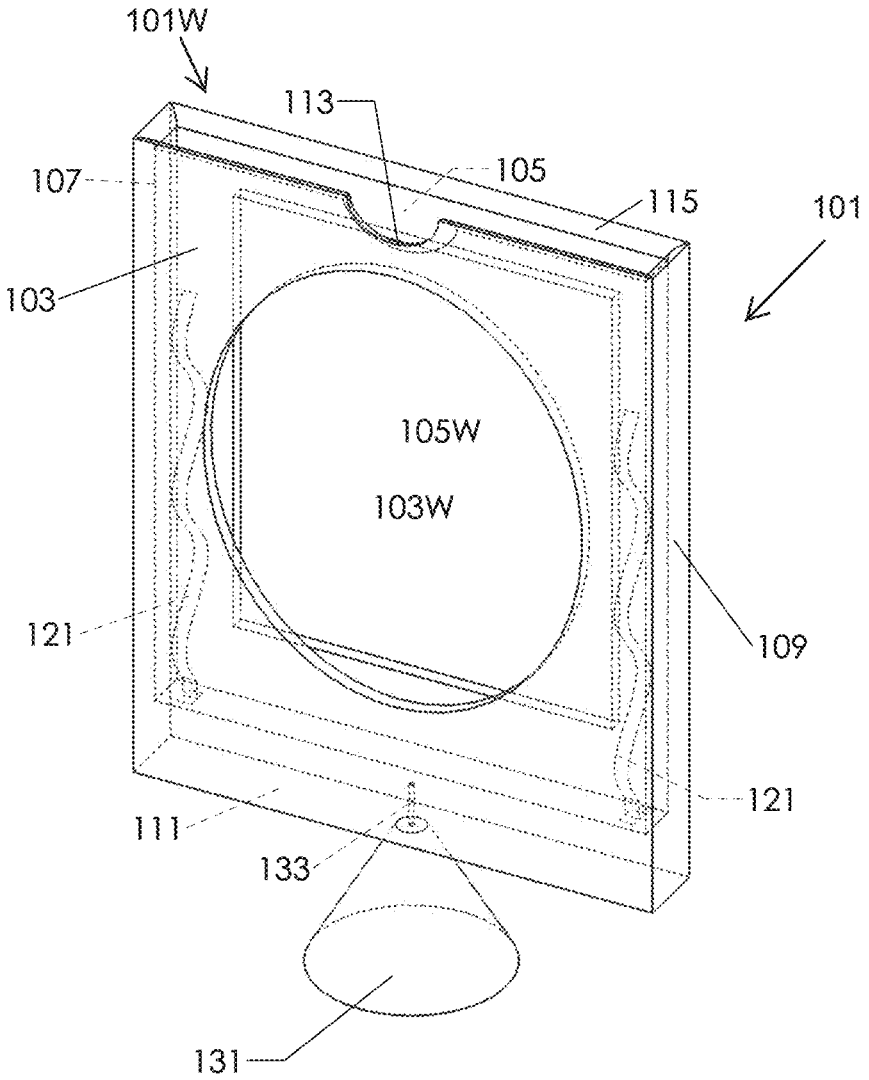
FIG. 1 is a three dimensional view of the first embodiment of current application.
Figure 2:
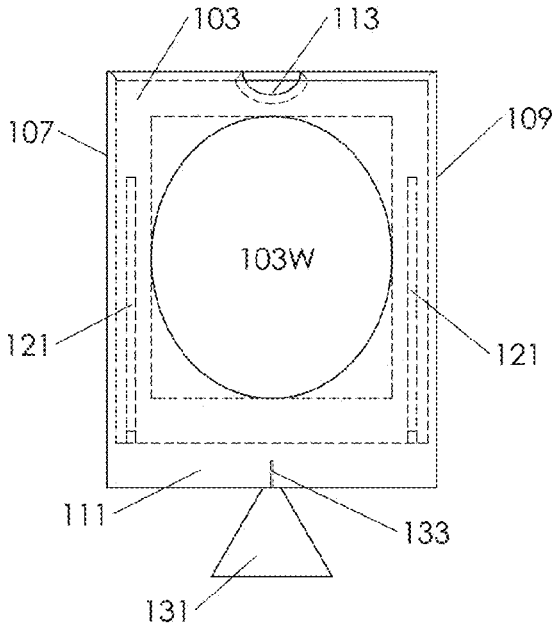
FIG. 2 is a front elevation view of the first embodiment of current application.

FIGS. 1 to 19 show the various views related to the first embodiment of the current application. As shown in FIG. 1, a display housing 101 has a front panel 103, back panel 105, two side panels 107 and 109, and one bottom panel 111 bounding a picture-storing cavity. The front panel 103 has an oval shape display window 103W. The back panel 105 has a rectangular display window 105W. A display window referred herein is a direct opening on a panel or a transparent view pane covering an opening on a panel. The display housing 101 has a top loading design. The top opening 101W allows the insertion and removal of sheets of materials into and from the display housing 101. A recess 113 on the front panel 103 facilitates the easier removal of sheets of materials from the display housing 101 by human hands. Fillets 115 around the top opening, of the inner edges of the front panel 103, back panel 105, and side panels 107 and 109, also facilitate easier insertion and removal of sheets of materials.

Figure 4:
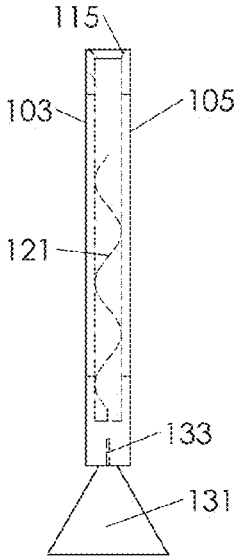
FIG. 4 is a right side elevation view of the first embodiment of current application.
Figure 3:
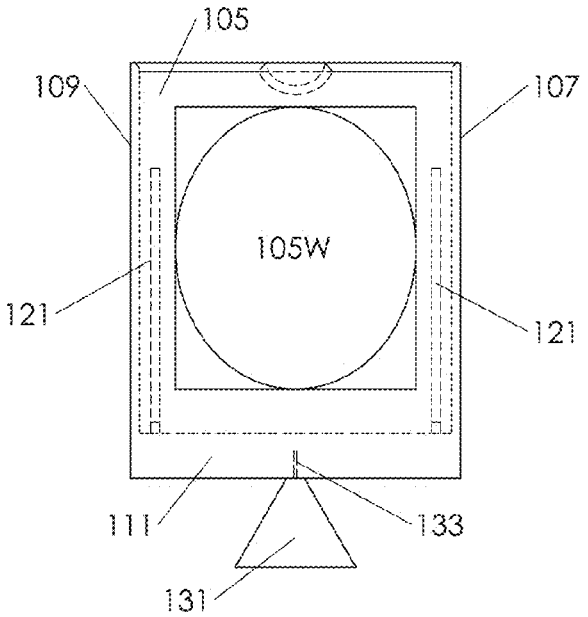
FIG. 3 is a back elevation view of the first embodiment of current application.
Figure 5:
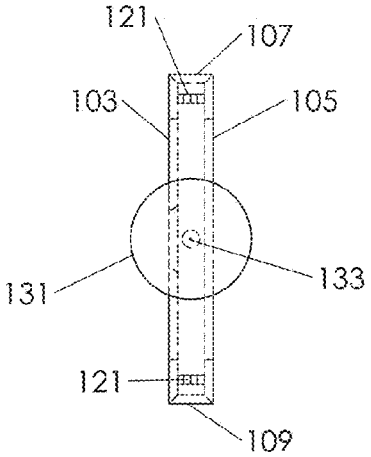
FIG. 5 is a bottom elevation view of the first embodiment of current application.
Figure 6:
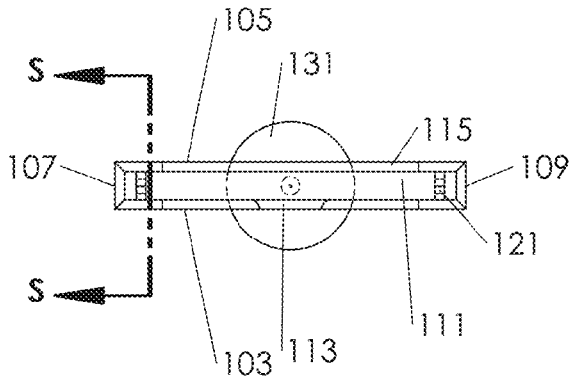
FIG. 6 is a top elevation view of the first embodiment of current application.
Figure 7:
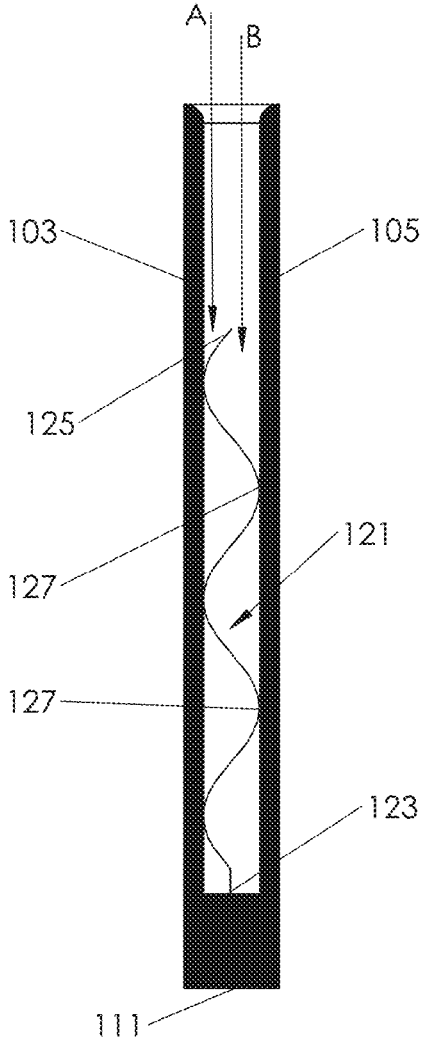
FIG. 7 is an enlarged cross-section view taken along the plane S-S in FIG. 6 of the first embodiment of current application.
Figure 8:
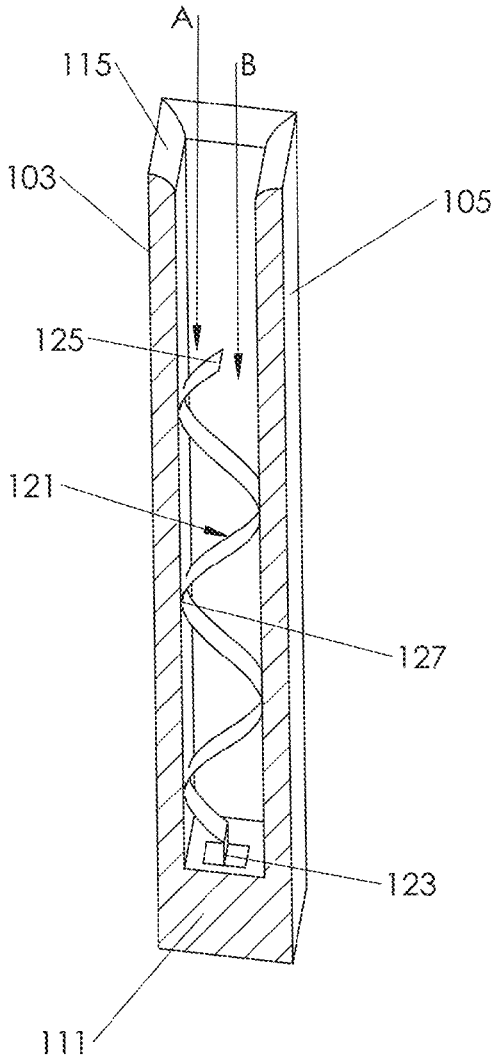
FIG. 8 is another enlarged cross-section view taken along the plane of S-S in FIG. 6 of the first embodiment of current application.
Figure 9:
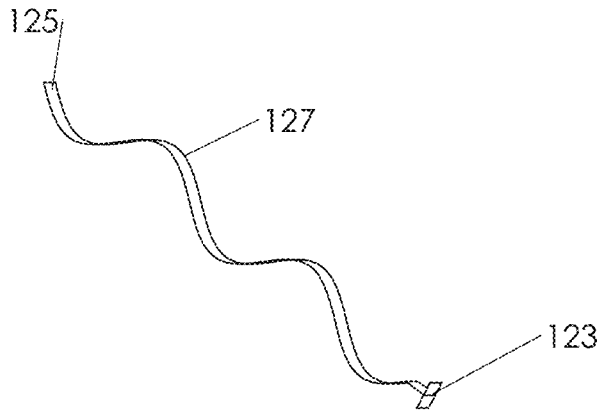
FIG. 9 is a three dimensional view of the linear wave spring installed in the first embodiment of current application.
Figure 10:
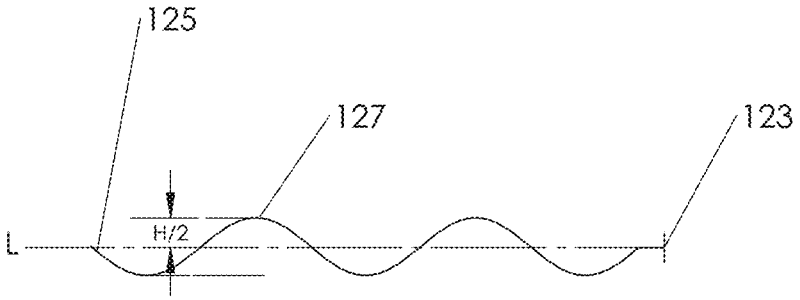
FIG. 10 is a right side elevation view of the linear wave spring installed in the first embodiment of current application (rotated 90 degree counter clock wise from the spring position in FIG. 4)
Figure 11:
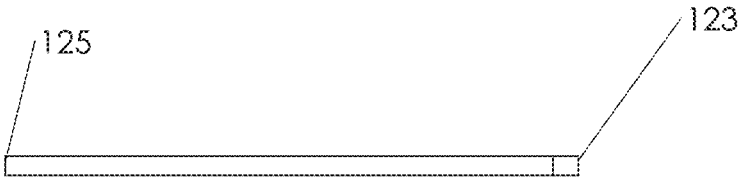
FIG. 11 is a front elevation view of the linear wave spring installed in the first embodiment of current application (rotated 90 degree counter clock wise from the spring position in FIG. 2)

Two linear wave springs 121 are installed inside the display housing 101. As shown in FIG. 4, the linear wave springs 121 have two and a half waves. FIG. 6 is a top elevation view of the first embodiment. FIGS. 7 and 8 are two enlarged cross section views taken along the plane S-S in FIG. 6 One end of the spring 121 with a "T" shaped footing 123 is attached to the inner surface of the bottom panel 111, which is more evidently shown in FIG. 8. The other end 125 is free and can extend upward. The two ends of the spring are substantially in the same plane of the neutral axis L of the spring, as shown in FIG. 10. A three dimensional view and a top elevation view of the spring design are shown in FIGS. 9 and 11, respectively.

As shown in FIGS. 7 and 8, three crest portions 127 engage the inner surface of the front panel 103; two crest portions 127 engage the inner surface of the back panel 105. Sheets of materials can be inserted in-between front panels 103 and the free ends 125 of the springs 121 following direction A. Sheets of materials can also be inserted in-between the back panel 105 and the free ends 125 of the springs 121 following direction B.

When sheets of materials are placed inside the display housing from direction A, the crest portions 127 engage the sheets of materials and hold them against the front panel 103. When sheets of materials are placed inside the display housing from direction B, the crest portions 127 hold the sheets against the back panel 105.

The spring 121 is made of resilient materials, such as metal and plastic. The more sheets of materials inserted into the display housing 101, the thicker the stack of the sheets, and the more support would be provided by the springs 121 to the sheets. The aforementioned spring design and installation method allow sheets of materials to be inserted into the display housing from both sides of the spring.

Figure 12:
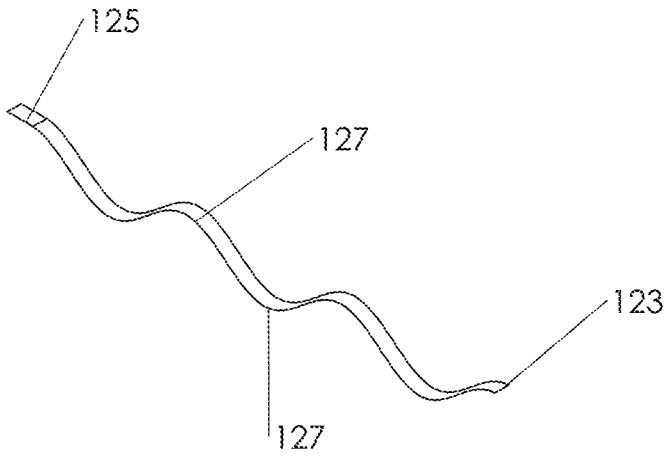
FIG. 12 is a three dimensional view of an alternative linear wave spring design installed in the first embodiment of current application.
Figure 13:
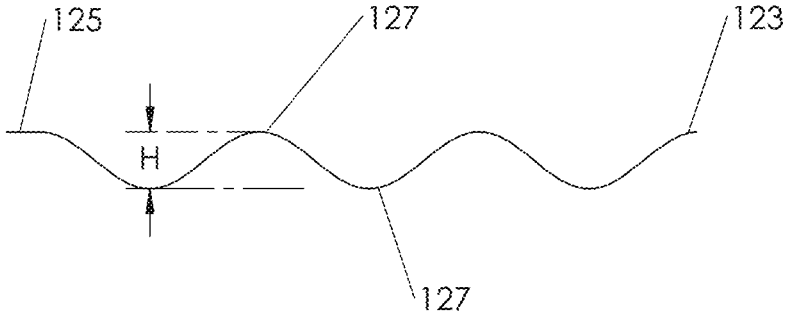
FIG. 13 is a right side elevation view of the alternative linear wave spring installed in the first embodiment of current application (rotated 90 degree counter clock wise from the spring position in FIG. 4)
Figure 14:
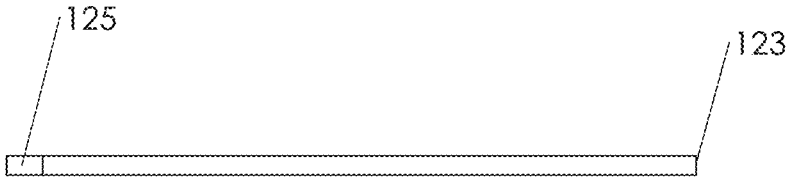
FIG. 14 is a front elevation view of the alternative linear wave spring installed in the first embodiment of current application (rotated 90 degree counter clock wise from the spring position in FIG. 2)
Figure 15:
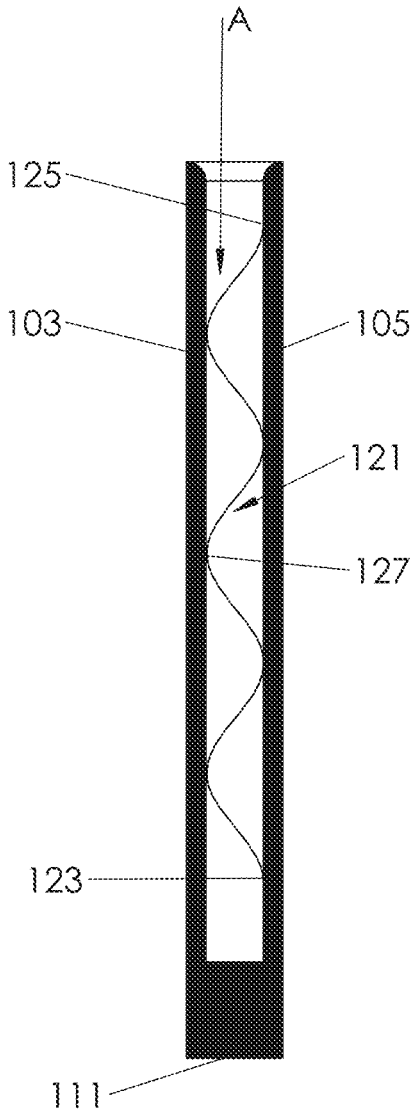
FIG. 15 is an enlarged cross-section view taken along the plane S-S in FIG. 6 of the first embodiment with the alternative linear wave spring installed inside.
Figure 16:
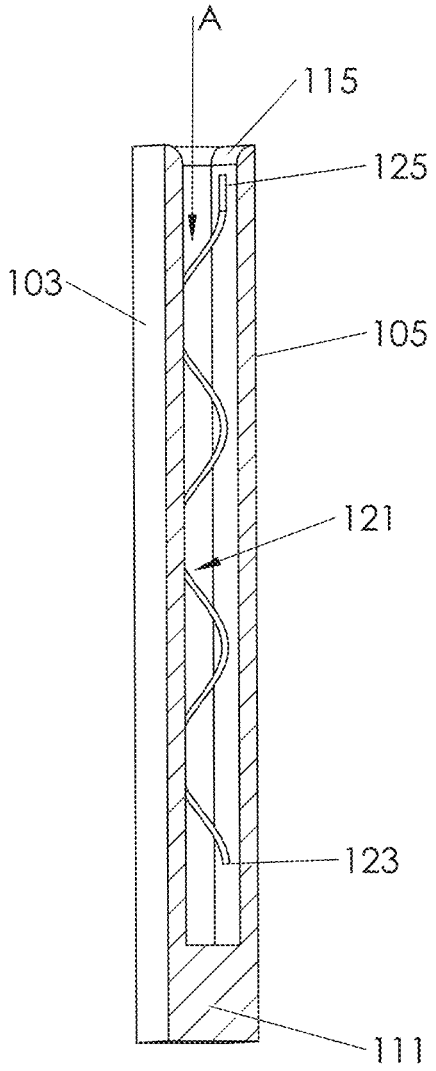
FIG. 16 is another enlarged cross-section view taken along the plane of S-S in FIG. 6 of the first embodiment with the alternative linear wave spring design installed inside.

FIGS. 12 to 14 show an alternative design of the linear wave spring. In this design, the end portions 123 and 125 are in the same plane of two of the crest portions 127. FIGS. 15 and 16 are two enlarged cross section views taken along the plane S-S in FIG. 6 when the alternative linear wave spring is installed inside the display housing 101. The end portion 125 is attached to the upper portion of the inner surface of the back panel 105. The other end 123 is free and is a short distance away from the bottom panel 111 inner surface. When a thick stack of sheets of materials is inserted, the freeway end 123 can extend downwardly toward the bottom panel 111.

With this alternative design of the linear wave spring in place, sheets of materials can be inserted in-between the front panel 103 and the spring end 125, as shown by direction A in FIGS. 15 and 16. When one sheet of material has visual information on both sides placed in the display housing, the two side visual information can be observed through the front display window 103W and the back display window 105W, respectively. This alternative spring design and installation allow sheets of materials to be inserted into the display housing from one side of the spring only.

The linear springs do not have to be fixed to the display housing panel surface when the free height of the spring wave H, shown in FIGS. 10 and 13, is equal or larger than the distance between the front panel 103 inner surface to the back panel 105 inner surface. The two panels will keep the springs in place. To increase the stability of the springs and prevent the springs from falling out, the spring 121 can be attached to the display housing 101 inner surface. The fixing area can be the spring end portion, 123 or 125, one of the crest portions 127.

The linear spring 121 can be designed with different shapes, lengths, and number of waves. The cross sections of the spring made at right angles to axis L in FIG. 10 can be a rectangle, a circle, or other shapes with various dimensions. It can be designed to have different levels of supporting strength for sheets of materials inserted. Besides the linear wave spring, other types of springs, such as spring clips, can also be installed between the front and back panels to hold and support the sheets of materials placed inside the display housing.

A base 131 shown in FIGS. 1 to 6 supports and engages the display housing 101 through a pin 133. The display housing 101 can rotate around the pin 133.

Figure 17:
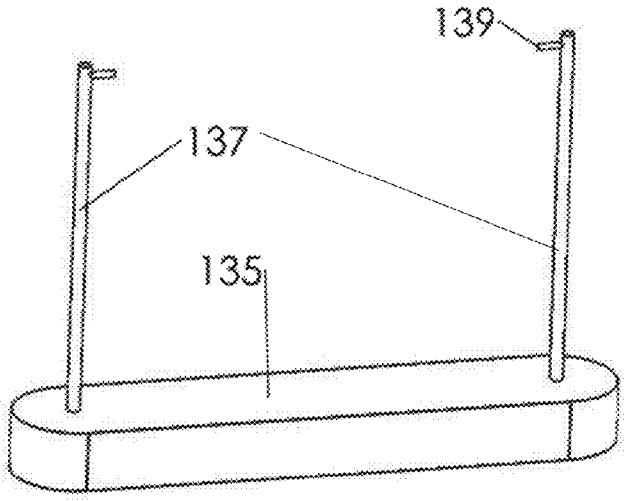
FIG. 17 is a three dimensional view of an alternative base design of the first embodiment of current application.
Figure 18:
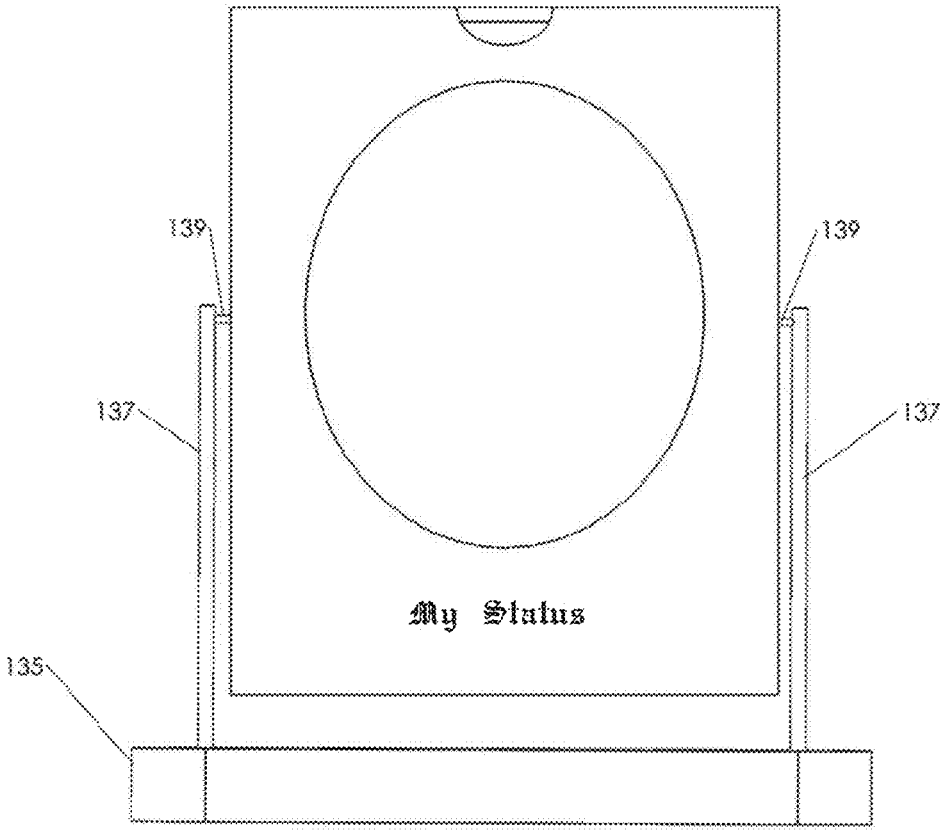
FIG. 18 is a front elevation view of the first embodiment of current application with the alternative base shown in FIG. 17.

FIG. 17 shows an alternative base 135 with two upright bars 137. Each of the upright bars has an ear 139 that can be connected to the side panels 107 and 109 of the display housing 101. The alternative base 135 holds the display housing 101 through the ears 139. The display housing 101 can swing around the two ears 139. FIG. 18 shows the front elevation view of the first embodiment with this alternative base installed.

To increase the stability of the device, a double-sided adhesive layer can be disposed on the bottom surface of the base 131 and 135 so that the device can be fixed to a surface. A double-sided adhesive layer can also be disposed on the outer surface of the back panel 105 so that the display housing 101 can be attached to a vertical surface such as a wall or door.

Figure 19:
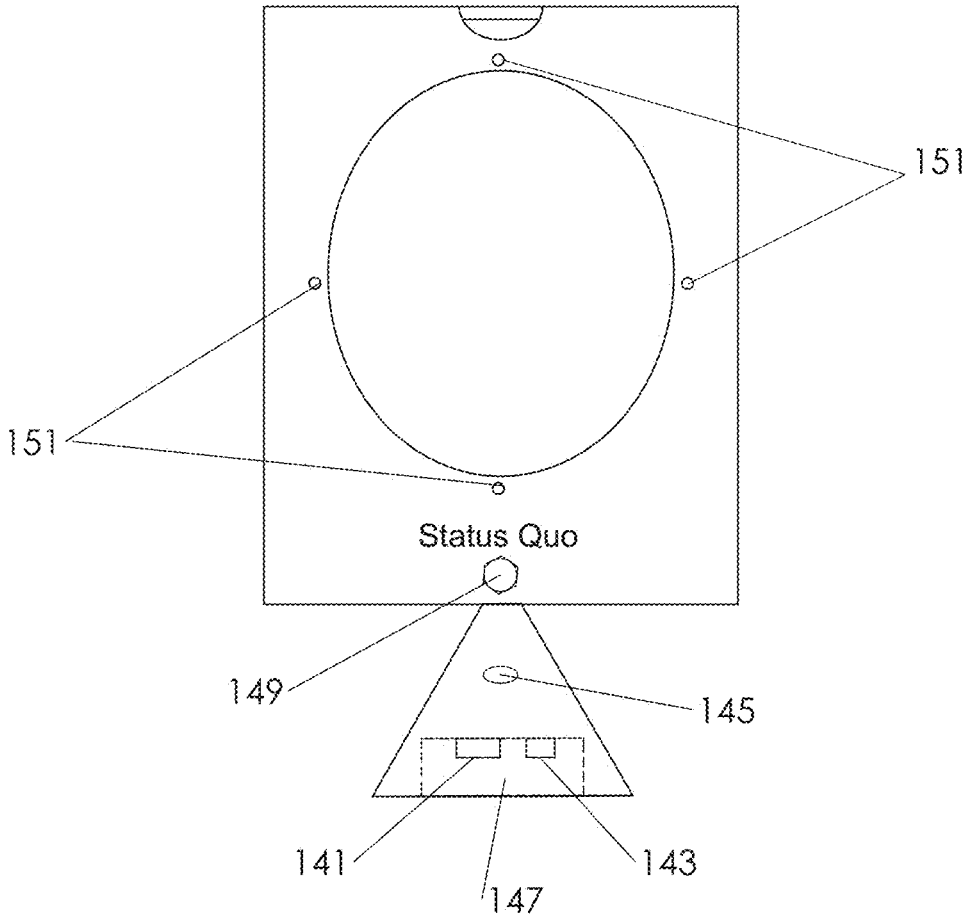
FIG. 19 is a front elevation view of the first embodiment of current application with a sound module and a light module installed.

As FIG. 19 illustrates, the device can further include a sound module 141 and a light module 143. The two modules can be turned on and off by a single switch mechanism or by two separate switch mechanisms. The modules can be installed inside a cavity 147 from the bottom of the base. A switch 145 can be positioned and installed on the surface of the base. A sensor 149, such as a motion sensor, can be embedded on the front panel surface of the display housing. The sensor can detect human presence and trigger the sound module 141 to play back a pre-loaded audio message and the light module 143 to illuminate the LED lights 151. The LED lights of the light module can be installed along the periphery of the front display window. Even further, a recording module may be included, which provides the user with the ability to record personalized messages. The recorded personalized messages can be played back when the module is activated by the sensor 149.

Users can print their own status pictures and messages for display in the first embodiment of the current application. One of the words "Status Quo," "My StatusQuo," or "My Status" may be printed on the surface of the device to indicate its intended use, as shown in FIGS. 18 and 19. The first embodiment can be used as a picture frame to display pictures. These pictures can be changed easily and conveniently. Additional pictures can be stored in the same display housing.

Figure 20:
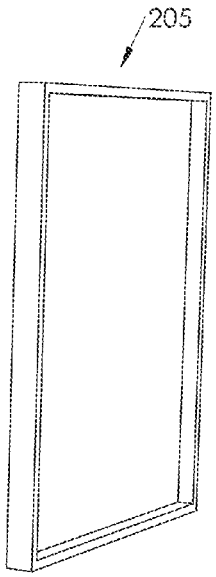
FIG. 20 is a perspective view of the back cover of the housing of the second embodiment.
Figure 21:
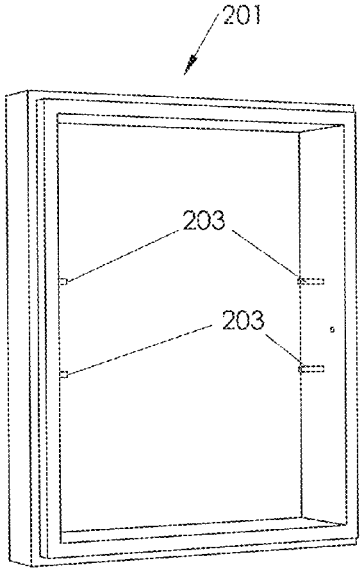
FIG. 21 is a perspective view of the housing of the second embodiment.
Figure 22:
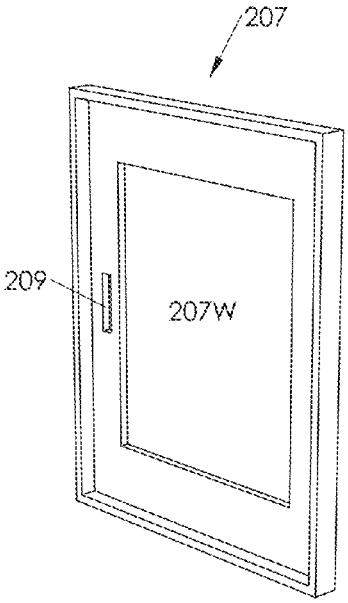
FIG. 22 is a perspective view of the front cover of the housing of the second embodiment.
Figure 23:
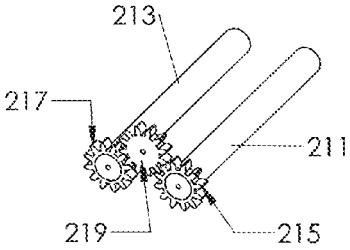
FIG. 23 is a three dimension view of the rollers and gears of the second embodiment.
Figure 24:
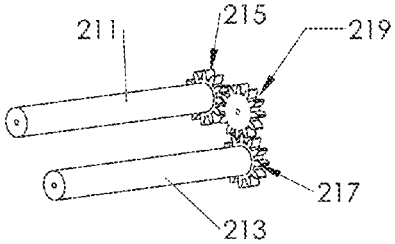
FIG. 24 is another three dimension view of the rollers and gears of the second embodiment.
Figure 25:
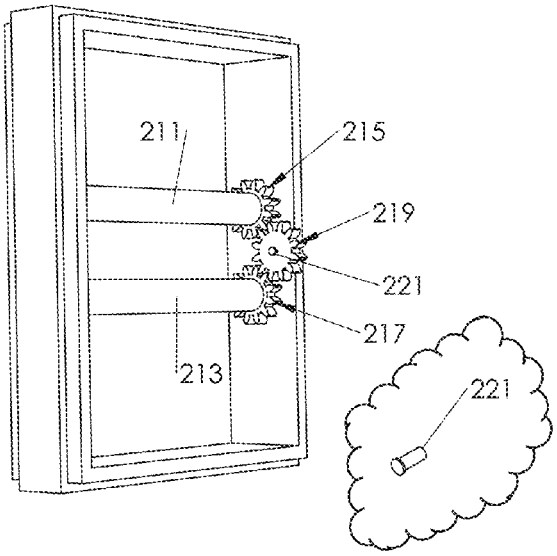
FIG. 25 is a perspective view of the housing with the rollers and gears installed inside of the second embodiment.
Figure 26:
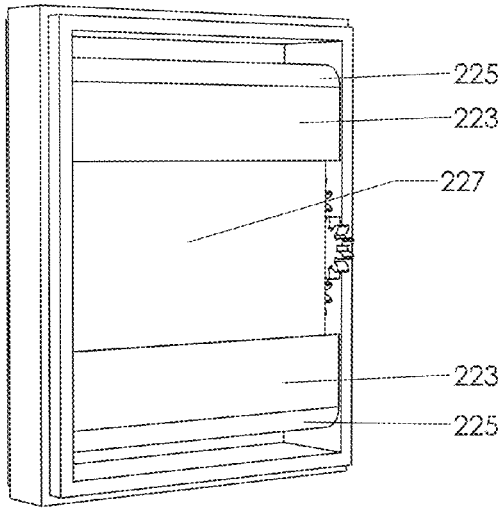
FIG. 26 is a front side perspective view of the housing with the rollers, gears, and supporting panels installed inside of the second embodiment.

FIGS. 20 to 38 show the various views related to the second embodiment of the current application. The device has a housing 201 with extruded pins 203 shown in FIG. 21. The housing has a back cover 205 shown in FIG. 20, a front cover 207 with a display window 207W, and a slot opening 209 shown in FIG. 22. The housing 201 supports a pair of parallel rollers 211 and 213 through the extruded pins 203 as shown in FIGS. 21 and 25. The two rollers, 211 and 213, have the same diameter and can rotate around the pins 203 within the housing. The rollers can be hollow or solid. As shown in FIGS. 23 and 24, the rollers are driven by three gears: 215, 217, and 219. Gears 215 and 217 have the same dimensions and are fixedly mounted to the ends of the two rollers, 211 and 213, respectively, in a coaxial relationship. The third gear 219 is installed onto the housing 201 through a pin 221 and can rotate around the pin 221, as shown in FIG. 25. The third gear 219 can be a different size as long as it meshes well with the other two gears. The gear 219 is positioned closer to the housing front opening, thus a small part of the gear 219 extrudes out of the housing front cover 207 through the slot opening 209. The extruded part of the gear, 219, can be driven by human hands, which is best shown in FIG. 33. The third gear 219 engages the other two gears 215 and 217. When the gear 219 turns, it drives the other two gears, 215 and 217, to turn. As gears 215 and 217 are fixed to the rollers 211 and 213 respectively, the turning of gears 215 and 217 drives the rollers 211 and 213 to rotate respectively at the same pace.

The third gear 219 can be replaced by any odd number (i.e. 3, 5, 7. . .) of the gears that can rotate the rollers 211 and 213 at the same pace.

Figure 31:
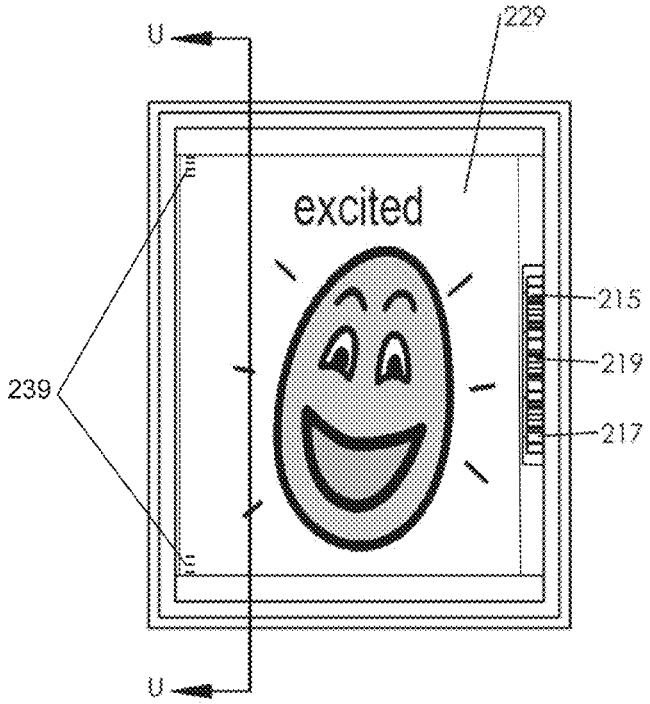
FIG. 31 is a front elevation view of the housing with the rollers, gears, supporting panels, and a sheet of material installed inside of the second embodiment.
Figure 32:
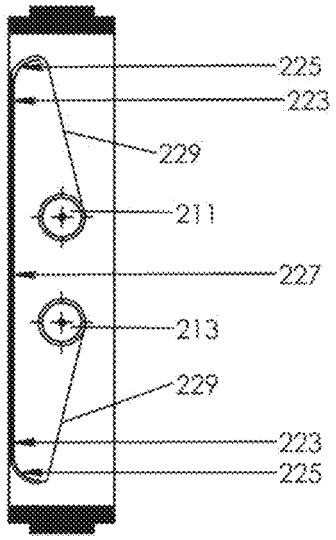
FIG. 32 is a cross-section view taken along the plane U-U in FIG. 31 of the housing with the rollers, gears, supporting panels, and a sheet of material installed inside.
Figure 33:
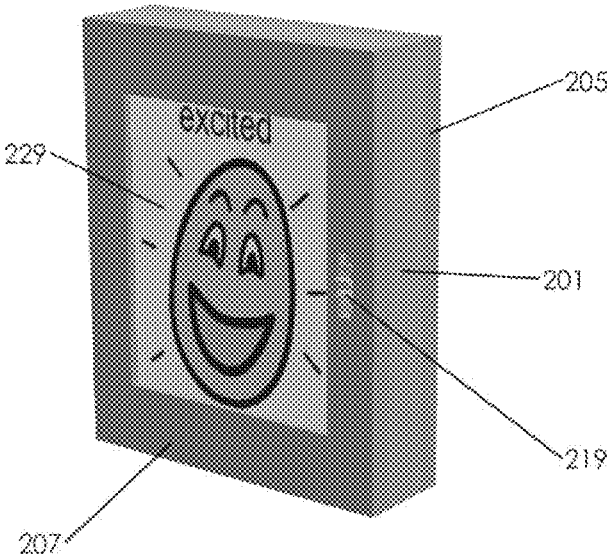
FIG. 33 is a perspective view of the second embodiment with back cover, rollers, gears, supporting panels, a sheet of material, and front cover in place.

One end of a long sheet of material, 229, shown in FIGS. 31 and 32, is attached to roller 211 and the other end is attached to roller 213. The sheet of material, 229, is adapted to be wound back and forth between the two rollers to display different visual information contained on the sheet. The sheet of material can be made of flexible, durable, high quality paper or fabric. The material should have sufficient breaking strength and ability to stand flexing. The visual information contained on the sheet is pictures and messages for expressing personal status, feelings, and emotions. Alternatively, the visual information such as images and messages are similar to typical greeting cards.

Figure 27:
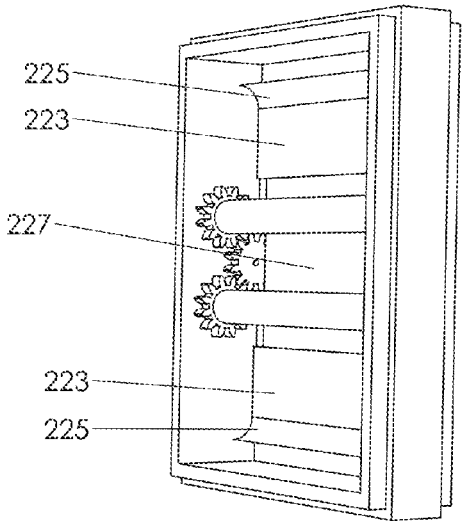
FIG. 27 is a back side perspective view of the housing with the rollers, gears, and supporting panels installed inside of the second embodiment.
Figure 28:
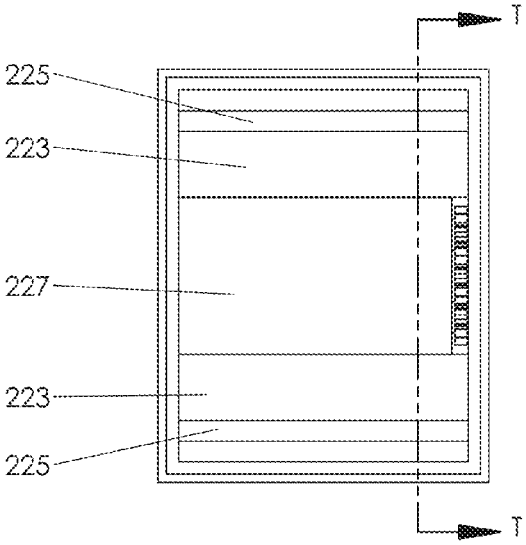
FIG. 28 is a front elevation view of the housing with the rollers, gears, and supporting panels installed inside of the second embodiment.
Figure 29:
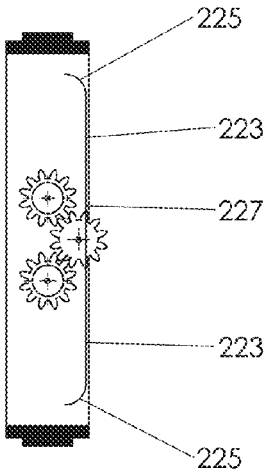
FIG. 29 is a cross-section view taken along the plane T-T in FIG. 28 of the housing with the rollers, gears, and supporting panels installed inside.
Figure 30:
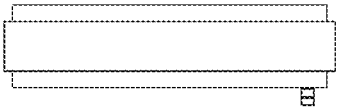
FIG. 30 is a top elevation view of the housing with the rollers, gears, and supporting panels installed inside of the second embodiment.

The sheet of material 229 passes over supporting panels 223 and 227 as shown in FIGS. 26 to 29 and 32. Panels 223 and 227 are in the same plane within the housing. Panel 223 comprise an upper panel and lower panel. As best shown in FIGS. 27, 29, and 32, the top portion of the upper panel 223 and the bottom portion of the lower panel 223 are curve shaped, indicated by area 225. Area 225 of the panel 223 is made of resiliently flexible material. The path of the sheet of material is shown in FIG. 32. FIG. 32 is a cross-section view of FIG. 31 taken along the plane U-U. The curved portion 225 is prestressed by the sheet of material 229 at installation of the sheet of material. The flexible panel curve helps to maintain tension in the sheet 229 as the two rollers rotate in synchronism and the diameter of the sheet on each roller varies. The middle section supporting panel 227 is rigid and can provide support for users to write on the sheet of material. During the manufacture process, the panel 227 and panel 223 may be produced as one piece, one panel with a flexible and curved top and bottom. The removable front cover 207 and back cover 205 as shown in FIGS. 20 to 22 allow openings on both sides of the housing 201 for easy installation of the sheet of material onto the rollers.

When the front cover 207 is at a closed position with the housing 201, as shown in FIG. 33, the spacing between the front cover 207 inner surface and the panels 223 and 227 is only wide enough to allow one sheet of material to pass through easily and smoothly as illustrated in FIG. 32. This thin space setting helps keep the sheet material straight and flat when moving through the display window of the front cover 207, even when portions of the sheet of material 229 near the rollers get loose and slack as the sheet of material 229 winds from one roller to the other.

Figure 34:
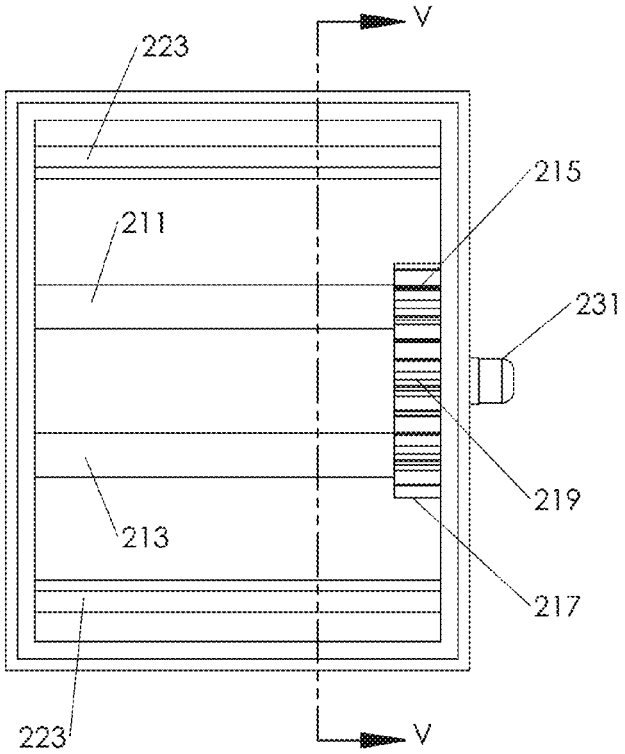
FIG. 34 is a front elevation view of a variation of the driving system of the second embodiment.
Figure 35:
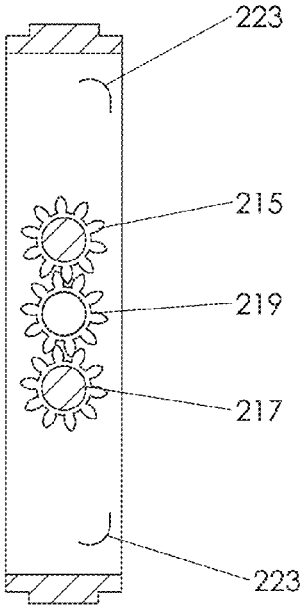
FIG. 35 is a cross-section view taken along the plane V-V in FIG. 34.
Figure 36:
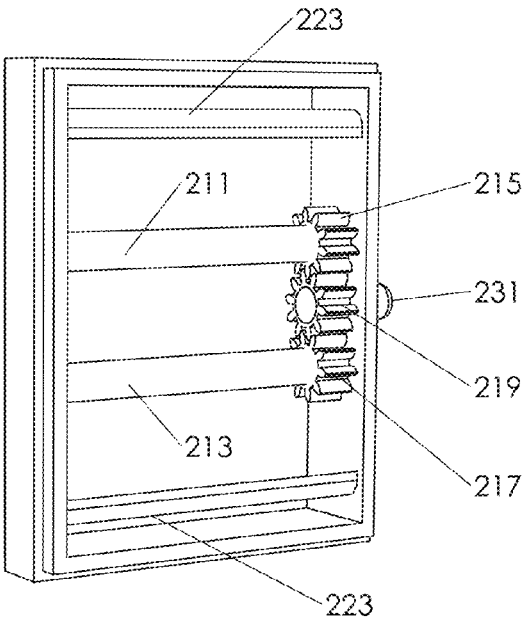
FIG. 36 is a front perspective view of a variation of the driving system of the second embodiment.

FIGS. 34 to 36 show a variation of the driving system of the second embodiment. The three gears 215, 217, and 219 are positioned on one line inside the housing. A turning knob 231 outside of the housing is fixed to the middle gear 219; turning the knob will rotate the rollers 211 and 213 concurrently. The flexible curved panels 223 will help the tension of the sheet of material to be installed inside the housing.

Figure 37:
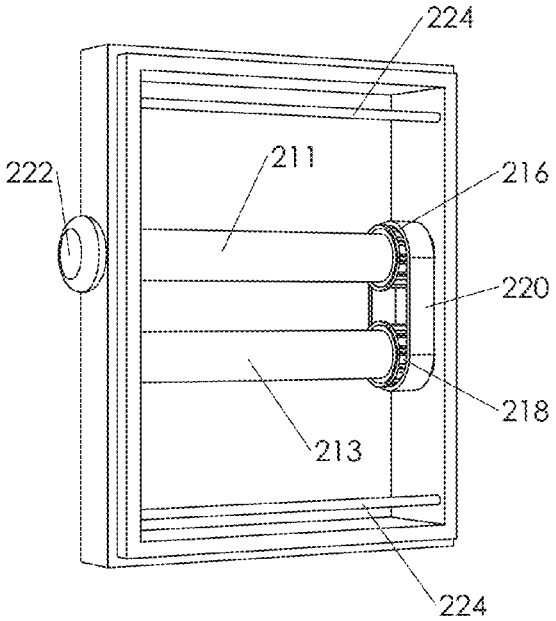
FIG. 37 is a front perspective view of another variation of the driving system of the second embodiment.

FIG. 37 shows another variation of the driving system of the second embodiment. A turning knob 222 is attached and fixed to the roller 211. Two same size toothed pulleys, 216 and 218, are fixed to the ends of the rollers, 211 and 213, respectively. Pulley 216 engages pulley 218 through a flexible toothed belt 220. When the knob 222 is turned, rollers, 211 and 213, will rotate in synchronism. Instead of using curved panels 223 to support the sheet of material, two idler rollers 224 are used for the sheet of material to pass over. One of the rollers is a tension roller to keep the sheet of material in tension. One example design of the tension roller can be found in U.S. Pat. No. 5,673,504.

From the above teaching, it is evident that the two rollers in the second embodiment can be driven and controlled by a gear drive, a timing belt drive, a chain drive, a dial cord drive system (e.g. the turner string on a radio), and planetary drive etc. It can be powered by man power or an electric motor system. The electric motor can be powered by DC or by AC.

Figure 38:
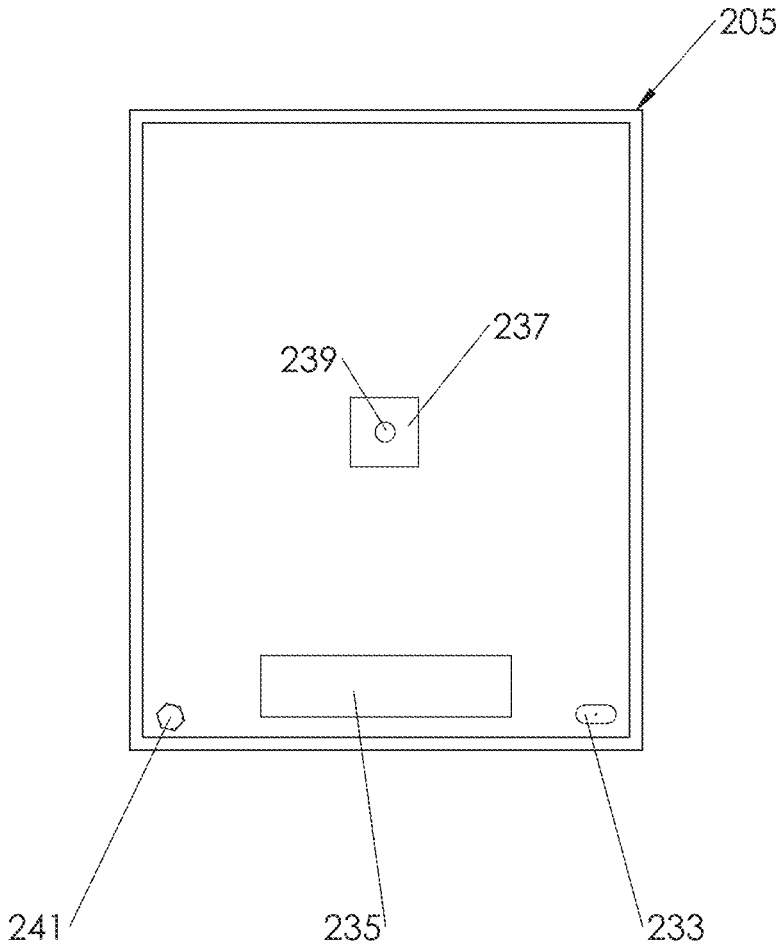
FIG. 38 is a front elevation view of the back cover of the second embodiment with, a sound module, a light module and sensors installed.

The second embodiment of current application can further include sound and light effects. As illustrated in FIG. 38, a motion sensor 233, a sound module 235, and a light module 237 with integrated LED light 239 are installed inside the housing on the back panel 205. The sound module 235 contains a speaker, a circuit board, an integrated circuit, a microprocessor, a power source, a memory device, at least one pre-loaded audio file, and any other part necessary. A motion sensor 233 can detect the movement of the sheet of material 229 shown in FIGS. 31 to 33 and trigger the sound module 235 to play back the audio messages and the light 239 of the light module 237 to illuminate. The lights may be programmed to strobe in sequence or blink randomly. Different light colorations may be used as well. Thus when the rollers, 211 and 213, are being rotated, the movement of the sheet of material 229 will be detected by the motion sensor 233, the sound module 235, and the light module 237 will be activated. A switch mechanism can turn off the lights and the sound module, thus movements detected by the sensor 233 will not trigger the illumination of the lights and the audio play back. The light module and the sound module may be controlled by separate switch mechanisms. When a light module is installed in the housing, the supporting panels, 223 and 227, as shown in FIGS. 26 to 29 can be made of clear plastic material so that the illumination effect will not be blocked by the panels.

In another form, the sheet of material has bar code information 239 or other coded data on its surface as shown in FIG. 31. Bar code reader or sensor 241 located inside the housing on the back panel, as shown FIG. 38, can read the coded information and provide the precise information as to the position of the sheet of material. The sound module and the light module have preloaded different audio and light illumination patterns for different positions of the sheet of material. When activated, the modules, accordingly, play different audio messages and light illumination associated with different visual information on the sheet of material. Even further, a recording module may be included, which provides the user with the ability to record personalized messages to be associated with different positions of the sheet of material.

The device described in the second embodiment of the current application can be used as a greeting box that contains multiple images and greeting messages. It will be a good use for greetings from multiple people with a common theme, such as a family birthday greeting with each family member having his/her own preferred images and messages.

The housings and the display windows discussed in the aforementioned embodiments of the current application are contemplated to be available in a plurality of numbers, sizes, and shapes. For example, an oval shape, a square, a rectangular shape, etc. They may include a decorative finish, style, and color. The apparatus can be designed as wall mountable or table top mountable; the apparatus can be made of plastic, china, wood, metal etc.

I claim:

1. A display device comprising:

a display housing including a front panel, one or more sheets of materials with visual information to be displayed, at least one opening located on said display housing whereby said sheets of materials can be placed into said display housing, at least one display window on said display housing whereby said sheets of materials can be observed, at least one spring installed in said display housing to hold said sheets of materials against a display housing inner surface, said spring is a linear wave spring and has a plurality of crests to provide support to said sheets of materials.

2. A display device according to claim 1, wherein said spring has at least one of the end portions or the crest portions attached to a display housing inner surface.

3. A display device according to claim 1, wherein said spring is designed and installed in a way that permits said sheets of materials to be inserted into said display housing from either side of said spring.

4. A display device according to claim 1, wherein said spring is designed and installed in a way that permits said sheets of materials to be inserted into said display housing from one side of said spring only.

5. A display device according to claim 1, wherein said display housing has at least one recess on a panel of said display housing for easier removal of said sheets of materials from said at least one opening.

6. A display device according to claim 1 further comprising a double-sided adhesive layer disposed on the surface of said back panel whereby said display housing can be attached onto a vertical surface.

7. A display device according to claim 1 further comprising a base to hold said display housing.

8. A display device according to claim 7, wherein said base has a pin to connect with and hold said display housing to allow said display housing to rotate around said pin, a double-sided adhesive layer disposed on the bottom surface of said base to increase stability.

9. A display device according to claim 1 further comprising at least one sensor, a light module, said sensor is used for detecting human presence and triggering said light modules to play back.

10. A display device according to claim 1, wherein there is one of the words "Status Quo," "My StatusQuo," or "My Status" on the surface of the device.

11. A display device according to claim 1 further comprising at least one sensor, at least one sound module, said sensor is used for detecting human presence and triggering said module to play back, said sound module comprises at least one pre-loaded audio file.

* * * * *